US005295788A

United States Patent [19]

Tajima et al.

[11] Patent Number: 5,295,788

[45] Date of Patent: Mar. 22, 1994

[54] ROTOR ASSEMBLY FOR SCREW PUMP

[75] Inventors: Katsunori Tajima; Mitsunori Arimura, both of Asaka; Mamoru Yoshikawa, Kawagoe; Tadashi Kimura, Tokyo, all of Japan

[73] Assignee: Honda Giken Kogyo Kabushiki Kaisha, Tokyo, Japan

[21] Appl. No.: 991,213

[22] Filed: Dec. 15, 1992

[30] Foreign Application Priority Data

Dec. 27, 1991 [JP] Japan ..... 3-346539

[51] Int. Cl.[5] ..... F04C 18/18; F04C 29/00

[52] U.S. Cl. ..... 416/204 R; 416/244 R; 418/201.1; 403/282; 403/359; 403/379

[58] Field of Search ..... 416/204 R, 204 A, 244 R, 416/244 A; 418/201.1; 403/282, 359, 360, 378, 379; 29/888.023

[56] References Cited

U.S. PATENT DOCUMENTS 2,236,980 4/1941 Ungar ..... 418/201.1
4,595,349 6/1986 Preston et al. .
4,747,763 5/1988 Sibata et al. .
4,764,098 8/1988 Iwase et al. ..... 403/379
4,828,467 5/1989 Brown ..... 418/201.1
4,886,392 12/1989 Iio ..... 403/282
5,018,953 5/1991 Matsubara et al. ..... 418/201.1

FOREIGN PATENT DOCUMENTS 1-21192 6/1989 Japan .

*Primary Examiner*—Edward K. Look
*Assistant Examiner*—James A. Larson
*Attorney, Agent, or Firm*—Armstrong, Westerman, Hattori, McLeland & Naughton

[57] ABSTRACT

A rotor assembly for a screw pump has a light alloy rotor main body having an axially extending central bore. A steel shaft is press-fitted into the central bore. A diametrically extending fixing pin is press-fitted through the rotor main body and the shaft. Friction forces between the rotor main body and the shaft are arranged to be larger on a discharge side of the rotor assembly than on a suction side thereof. The fixing pin is disposed at substantially a central position of entire friction forces in terms of their directions and magnitudes.

9 Claims, 2 Drawing Sheets

ROTOR ASSEMBLY FOR SCREW PUMP

BACKGROUND OF THE INVENTION

The present invention relates to a rotor assembly for a screw pump which compresses a gas and is used for supercharging of an engine or the like, and more particularly to a means for fixing a shaft and a rotor main body in the rotor assembly.

For example, in Japanese Published Examined Utility Model Registration Application No. 21192/1989, there is known a rotor assembly of a pump for handling a gas, in which a guide portion and a serrated portion are sequentially provided in a shaft in the longitudinal direction thereof, the shaft is pressingly fitted or press-fitted into a central bore in a rotor main body, and a pin which penetrates the rotor main body and the shaft in the diametrical direction is press-fitted at a substantially central position in the longitudinal direction of the rotor assembly, thereby fixing the rotor main body and the shaft together.

In this kind of rotor assembly, it is normal practice to make the shaft of a steel, and to make the rotor main body of an aluminum alloy so that the rotor main body can be made light in weight and that the coefficient of thermal expansion becomes equal to that of a housing of the pump. However, the rotor assembly is heated by the compression heat of the gas, and the coefficient of thermal expansion of the steel of $11\times10^{-6}$ is largely different from that of the aluminum alloy of 20 to $23\times10^{-6}$, resulting in a large difference in the amount of expansion and contraction due to the changes in temperature. It follows that, if the pin is located in the shaft and the rotor main body at a position where an axial displacement relative to each other is likely to occur and the displacement is large, there will occur an excessive bearing pressure or surface pressure on the rotor main body at the portion where the pin is press-fitted into a pin hole in the rotor main body, accompanied by a fear that the pin hole is so enlarged that the interference fit condition can no longer be maintained.

OBJECT AND SUMMARY OF THE INVENTION

It is an object of the present invention to provide a rotor assembly for a screw pump in which a fixing pin is disposed such that the above-described excessive bearing pressure is not generated even if the temperature of the rotor assembly is changed.

According to the present invention, in order to attain the above object, a rotor assembly for a screw pump comprises a light alloy rotor main body having an axially extending central bore, a steel shaft frictionally connected by press-fitting into the central bore, and a diametrically extending fixing pin press-fitted through the rotor main body and the shaft, wherein friction forces between the rotor and the shaft are arranged to be larger on a discharge side of the rotor assembly than on a suction side thereof and wherein the fixing pin is disposed at a substantially central position of entire friction forces in terms of their directions and magnitudes.

According to another aspect of the present invention, a rotor assembly for a screw pump comprises a light alloy rotor main body having an axially extending central bore, a steel shaft which is frictionally connected by press-fitting into the central bore, and a diametrically extending fixing pin press-fitted through the rotor main body and the shaft, wherein a frictional connecting portion on a discharge side of the rotor assembly is made in a press-fitting construction provided with serrations on the shaft, wherein a frictional connection on a suction side of the rotor assembly is made in a press-fitting construction having a round bar, wherein friction forces between the rotor and the shaft are arranged to be larger at the discharge side than at the suction side, wherein a substantially central position of entire friction forces in terms of directions and magnitudes is set to fall within a portion provided with said serrations, and wherein the fixing pin is disposed at the substantially central position.

If the fixing pin is disposed in the above-described position, the axial friction forces resisting the thermal distortions of the rotor main body at the shaft-fitting portion are substantially well balanced at the position of the fixing pin. Therefore, the thermal stresses in the axial direction to act on the fixing pin which is embedded therein are small and, consequently, the bearing pressure to act on the pin hole does not exceed an allowable value.

BRIEF DESCRIPTION OF THE DRAWINGS

The above and other objects and the attendant advantages of the present invention will become readily apparent by reference to the following detailed description when considered in conjunction with the accompanied drawings wherein.

DETAILED DESCRIPTION OF A PREFERRED EMBODIMENT

One embodying example will now be explained with reference to the accompanying drawings.

Figure 1:
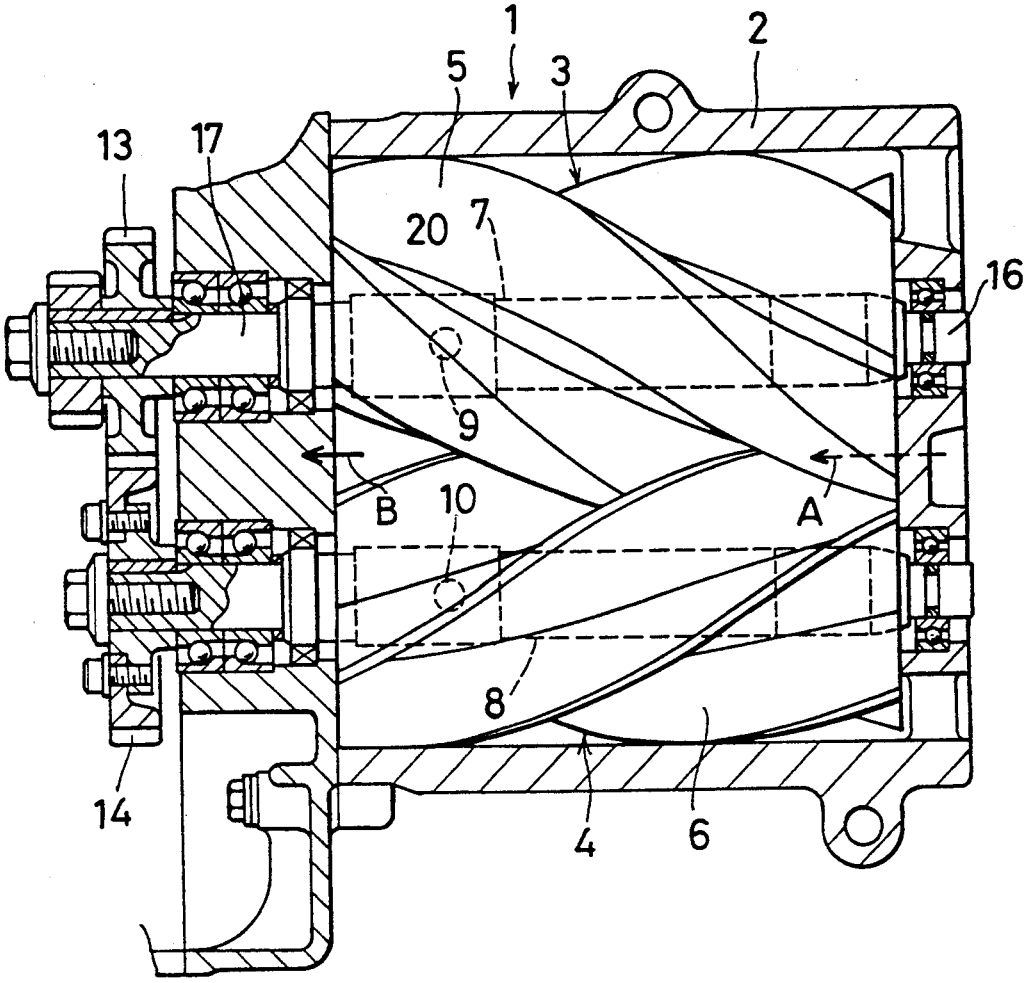
FIG. 1 is a horizontal sectional view showing an embodying example of the present invention.
Figure 2:
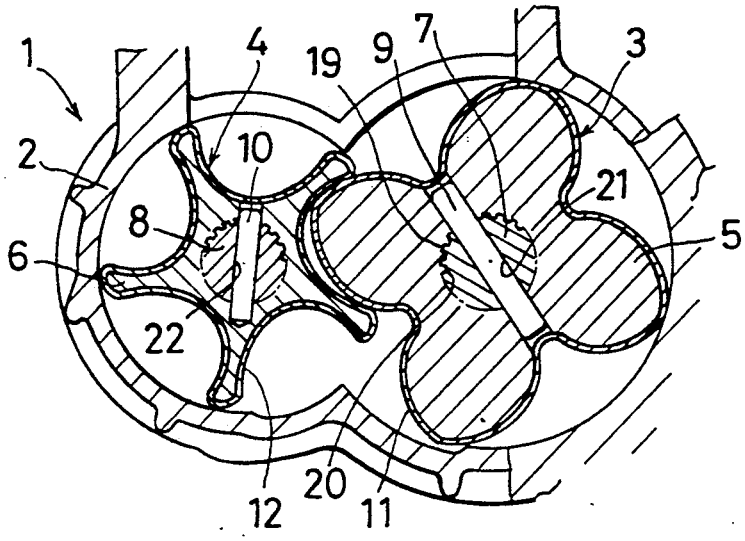
FIG. 2 is a vertical sectional view thereof.

In FIGS. 1 and 2, numeral 1 denotes a screw pump which is provided with rotor assemblies according to the present invention, numeral 2 denotes a casing of the screw pump 1, numeral 3 denotes a male rotor assembly and numeral 4 denotes a female rotor assembly. Each of the rotor assemblies 3, 4 comprises a light alloy rotor main body 5, 6 which has screwed vanes, and a steel shaft 7, 8 which is fitted into the rotor main body 5, 6. Each of the rotor assemblies 3, 4 is prevented from being pulled out by means of a fixing pin 9, 10 of light alloy make and is coated with a resin coating 11, 12 on its surface. Both shafts 7, 8 are interlocked with gears 13, 14 such that a gas is sucked into a lower part, as seen in FIG. 1, of the rotor assembly in the direction of an arrow A and is axially compressed between the vanes before being discharged out of an upper part, as seen in FIG. 1, of the rotor assembly in the direction of an arrow B.

Figure 3:
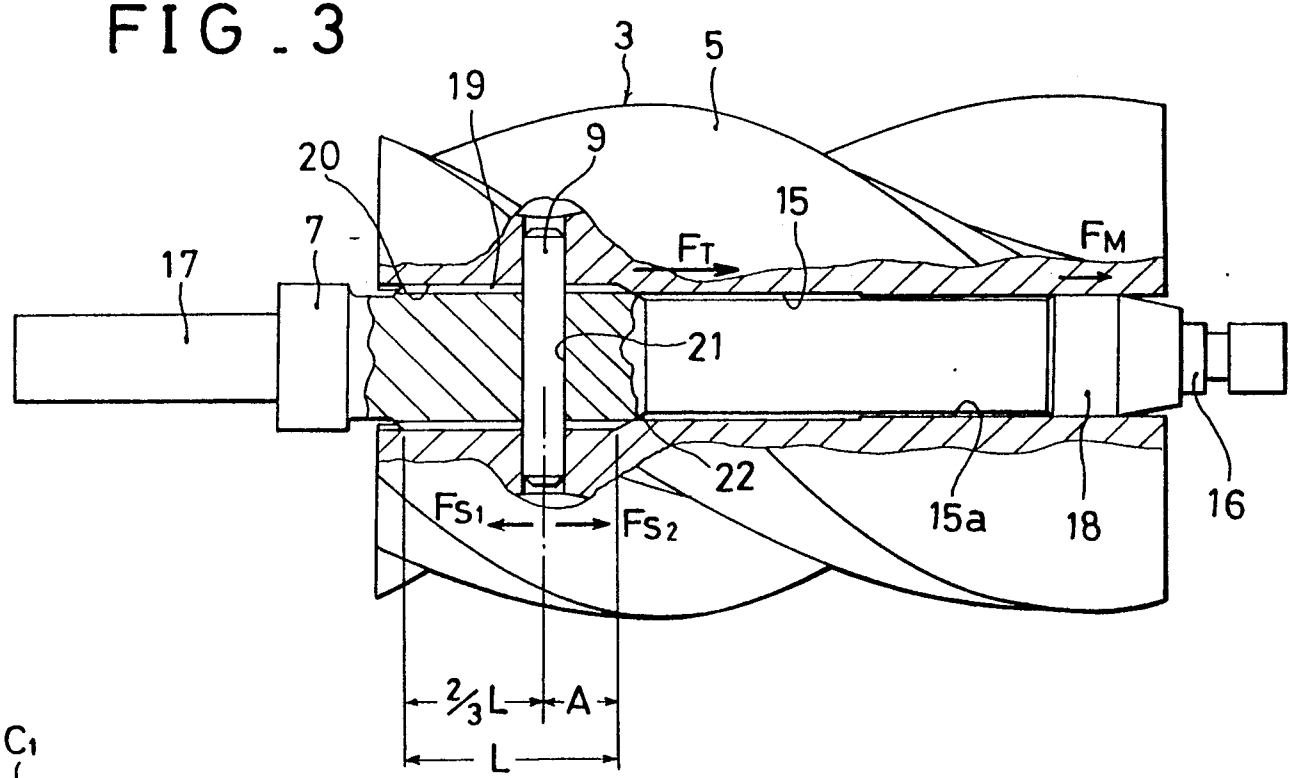
FIG. 3 is a side view, partially in section, of an important portion thereof.

FIG. 3 represents the male rotor assembly 3. In the rotor main body 5 there is provided a central bore 15 which extends in the axial direction. A small-diameter portion 15*a* is provided in the right half of the central bore 15. The shaft 7 is provided on both ends thereof with bearing fitting portions 16, 17. In an intermediate portion of the shaft 7, there are provided a press-fitting portion 18 which is slightly larger in diameter than the small-diameter portion 15*a* and a serrated portion 19 which has a larger diameter than the small-diameter portion 15*a*.

In order to fixedly mount the shaft 7 to the rotor main body 5, the shaft 7 is inserted into the central bore 15 from the side of the bearing fitting portion 16 forwards. The fitting portion 18 is pressingly inserted or press-fitted into the small-diameter portion 15*a* to maintain a coaxial relationship of the two members. The serrated portion 19 is then press-fitted into the central bore 15 to form a serrated portion 20 on the internal surface of the central bore 15, thereby connecting the two members while preventing the relative rotation to each other.

Thereafter, in order to prevent the shaft 7 from coming off, a pin hole 21 is bored by drilling and a fixing pin 9 is press-fitted into the pin hole 21. The position of disposing the fixing pin 9 is preferably located in a position in which the central bore 15 and the shaft 7 are closely fitted together; it is therefore disposed in the serrated connection portion. After the fixing pin 9 has been press-fitted, the rotor assembly 3 is inserted into a female mold which has an internal contour corresponding to an exact outer shape of the rotor assembly, and then a high-temperature molten resin is filled into the space between the two members and is cooled to form the above-described resin coating 11.

The amount of interference at the time of press fitting of the shaft is kept large enough to maintain an interference fit condition even at the time of temperature rise of the rotor assembly. However, if the amount of interference is made large, there will occur problems of bending of the shaft, scoring at the press-fitted portion, or the like, due to too large a press-fitting load, resulting in a failure in lubricating films even if grease lubrication is applied. Therefore, it is preferable to apply lead plating or to use solid lubricants such as graphite and molybdenum disulfide for the purpose of lubrication at the time of press fitting of the shaft.

In the above-described rotor assemblies 3, 4, if the rotor main bodies 5, 6 are made of light alloy and the shafts 7, 8 are made of steel, there will occur a relative axial movement due to the difference in the coefficients of thermal expansion even if both members are fitted together by press fitting. As a consequence, if the fixing pin is located at a position in which the relative movement is large, the fixing pin is subjected to a pressure with the result that this pressure is further added to the pressure due to the amount of interference at the time of press fitting of the pin. It follows that a bearing pressure or surface pressure exceeding the allowable value may sometimes be applied to the pin hole of the rotor main body which is smaller in strength.

Figure 4:
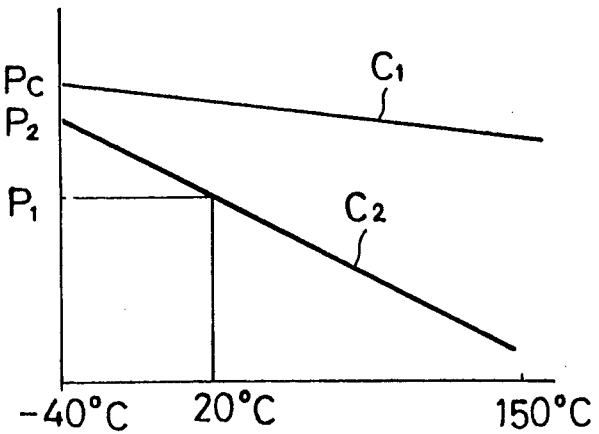
FIG. 4 is a diagram showing the relationship between bearing pressures and temperatures.

In FIG. 4, reference character $C_1$ denotes an allowable bearing pressure of an aluminum alloy at −40° C. to +150° C. With the increase in temperature the allowable bearing pressure slightly decreases. Reference character $C_2$ shows how the bearing pressure due to the amount of interference varies with the temperature. Even if the fixing pin is press-fitted at a bearing pressure $P_1$ of 20° C., the bearing pressure becomes close to zero in the neighborhood of 150° C. At −40° C. which is near a minimum temperature in cold regions, the bearing pressure becomes $P_2$ which is close to an allowable bearing pressure PC. Should an extra force be applied, at such a low temperature, to the pin connecting portion by starting rotation or the like, before an engine containing therein the screw pump has been heated enough, the bearing pressure would easily exceed the line $C_1$.

Therefore, according to the present invention, the fixing pin is disposed at a position in which the above-described pressure is considered to be the smallest. A more detailed explanation is made about this with reference to the male rotor assembly 3 in FIG. 3. It is, however, to be added that the same can apply to the female rotor assembly 4.

In FIG. 3, the serrated portion 20 on the side of the central bore 15 is forcibly formed through press-fitting of the serrated portion 19 on the side of the shaft 7 and, in addition, the contact area thereof is large. Therefore, a contact pressure and a consequent friction resistance at this portion are large. On the contrary, an axial friction resistance between the press fitting portion 18 and the small-diameter portion 15*a* is remarkably small. It follows that, when the rotor assembly 3 is cooled from an elevated temperature, the portion on the right side of a certain neutral point defined in the serrated portion 20 will be contracted towards the left, and the portion near the left end within the serrated portion 20 will be contracted rightwards towards the neutral point. Let the friction resistance forces through these contractions be FM in the press-fitting portion 18, $FS_1$ in the left side portion, as seen from the fixing pin 9, of the serrated portion 20, and $FS_2$ in the right side portion, as seen from the fixing pin 9, of the serrated portion 20. Further, let the reaction force to be generated at an abutting portion 22 at the ends of the serrated portions 19, 20 be FT and let the force required to restrain the sliding movement between the rotor main body 5 and the shaft 7 be F'. Then, no force other than the force to be generated in the interference between the fixing pin 9 and the pin hole will be acted on the fixing pin 9 if the fixing pin 9 is press-fitted at a position which is defined by the following formulas:

$$FS_1 \geqq F' \text{ and}$$

$$FS_2 + FT + FM \geqq F$$

For convenience' sake, that force acting on the left side of the fixing pin 9 which includes $FS_1$ is defined to be F1 and those forces acting on the right side of the fixing pin 9 which include $FS_2$, FT and FM are defined to be F2.

In the above formula, $FS_1$ is equal to or larger than F'. It is to be noted that $FS_2$ alone without FT and FM may also be made equal to or larger than F'.

In the embodying example shown in FIG. 3, the following relationship was obtained through experiments made by the inventors.

$$Fs_1 + Fs_2 = 1.5F \text{ and}$$

$$FT + FM > F$$

The right limit position of the fixing pin 9 in this case is at the position corresponding to the abutting portion 22. The left limit position thereof is at a position of ⅔L from the left end of the serrated portion 19 where L is the total length of the serrated portion 19. As long as the fixing pin 9 is press-fitted within the range A in FIG. 3, there will be no axial force applied to the fixing pin 9. The value F' and the other values in the above-described formulas are obtained from a temperature (e.g., −40° C.) at a cold time when the pump is to be used.

In a screw pump, the discharge side of the rotor becomes high both in temperature and pressure and the effect, on the pump characteristics, of the clearance between the discharge end surfaces of the rotor main bodies 5, 6 and the housing is large. Therefore, it is preferable that this clearance is small and that the clearance is not subject to the effect of the thermal expansions and contractions of the rotor main bodies 5, 6. Therefore, the friction force between the rotor main bodies 5, 6 and the shafts 7, 8 must be made larger on the discharge side than on the suction side so that displacement may hardly occur.

In case where the position of the fixing pin 9 is set within the range A as described above, it is preferable to place it nearest the discharge side within that range. By this arrangement, the amount of thermal expansion of the rotor main body towards the discharge side is minimized even at the time when the friction force between the rotor main body and the shaft decreases at the time of overheating, thereby preventing the contact of the rotor main body with the housing.

An explanation has hereinabove been made about an example in which a serrated portion is provided at the press-fitting portion of the rotor main body and the shaft. It should be added, however, that the present invention can also be applied to an example in which the rotor main body is fixed only by the interference and the fixing pin.

As can be seen from the above description, since the fixing pin is provided at a portion where the relative movement due to the thermal distortions between the rotor main body and the shaft is small, the present invention has the following advantages, i.e., that the bearing or surface pressure which acts on the fixing pin and the pin hole due to the thermal distortions is small and that, even if the rotor main body is made of a light material of lower strength, the pin hole can be prevented from being enlarged.

It is readily apparent that the above-described rotor assembly for a screw pump has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A rotor assembly for a screw pump comprising a light alloy rotor main body having an axially extending central bore, a steel shaft frictionally connected by press-fitting into said central bore, and a diametrically extending fixing pin press-fitted through said rotor main body and said shaft, wherein friction forces between said rotor and said shaft are arranged to be larger on a discharge side of said rotor assembly than on a suction side thereof and wherein said fixing pin is disposed at substantially a central position of entire friction forces in terms of their directions and magnitudes.

2. A rotor assembly for a screw pump according to claim 1, wherein said substantially central position is set within a range which is defined by the formulas $$F1 \geqq F' \text{ and}$$

$$F2 \geqq F'$$

where F1 is an axial friction resistance force on said discharge side as seen from said fixing pin, F2 is an axial friction resistance force on said suction side as seen from said fixing pin due respectively to press-fitting of said rotor main body and said shaft, and F' is a force to restrain slippage due to thermal distortions between said rotor main body and said shaft.

3. A rotor assembly for a screw pump according to claim 2, wherein said position of press-fitting said pin is set near a discharge end within said range.

4. A rotor assembly for a screw pump according to claim 2, wherein said force F' due to thermal distortions is obtained under a condition in which said rotor assembly is cool.

5. A rotor assembly for a screw pump comprising a light alloy rotor main body having an axially extending central bore, a steel shaft frictionally connected by press-fitting into said central bore, and a diametrically extending fixing pin press-fitted through said rotor main body and said steel shaft, wherein: a first frictional connecting portion on a discharge side of said rotor assembly is made in a press-fitting construction between said main rotor body and said steel shaft by providing serrations on said shaft; a second frictional connecting portion on a suction side of said rotor assembly is made in a press-fitting construction; friction forces between said rotor and said shaft are arranged to be larger on said discharge side than on said suction side; a substantially central position of entire friction forces in terms of their directions and magnitudes is set to fall within a portion provided with said serrations; and said fixing pin is disposed at said substantially central position.

6. A rotor assembly for a screw pump according to claim 5, wherein said substantially central position is set within a range which is defined by the formulas $$F1 \geqq F' \text{ and}$$

$$F2 \geqq F'$$

where F1 is an axial friction resistance force on said discharge side as seen from said fixing pin, F2 is an axial friction resistance force on said suction side as seen from said fixing pin due respectively to press-fitting of said rotor main body and said shaft, and F' is a force to restrain slippage due to thermal distortions between said rotor main body and said shaft.

7. A rotor assembly for a screw pump according to claim 6, wherein said force F1 includes a friction resistance force through contraction on said discharge side, as seen from said fixing pin on said portion of said shaft provided with said serrations, and wherein said force F2 includes a friction resistance force through contraction on said suction side, as seen from said fixing pin on said portion of said shaft provided with said serrations, a reaction force to be generated at an abutting end of said portion of said shaft provided with said serrations, and a friction resistance force through contraction in said press-fitting construction on said suction side of said rotor assembly.

8. A rotor assembly for a screw pump according to claim 6, wherein said position of press-fitting said pin is set near a discharge end within said range.

9. A rotor assembly for a screw pump according to claim 6, wherein said force F' due to thermal distortions is obtained under a condition in which said rotor assembly is cool.

* * * * *